United States Patent [19]

Hobson

[11] Patent Number: 4,693,512

[45] Date of Patent: Sep. 15, 1987

[54] SWING SEATING UNIT

[76] Inventor: J. David Hobson, 34 Eagle Street East, Newmarket, Ontario, Canada, L3Y 1J1

[21] Appl. No.: 915,052

[22] Filed: Oct. 3, 1986

[51] Int. Cl.[4] ..... A47D 13/10

[52] U.S. Cl. ..... 297/277; 297/184; 297/441; 297/457

[58] Field of Search ..... 297/16, 457, 441, 184, 297/277; 5/121, 120; D21/246

[56] References Cited

U.S. PATENT DOCUMENTS

| | | | |
|---|---|---|---|
| D. 260,110 | 8/1981 | Gomes | D21/246 |
| 2,561,886 | 7/1951 | Rikelman | 297/184 X |
| 3,459,423 | 8/1969 | Meade | 297/277 X |
| 3,643,997 | 2/1972 | Gilbert | 297/457 X |
| 4,221,429 | 9/1980 | Wade | 297/184 X |

*Primary Examiner*—James T. McCall

*Attorney, Agent, or Firm*—MacLeod, Knox, Watts

[57] ABSTRACT

A seating unit for a swing is disclosed and comprises a seating section and a suspension section with the seating section including a frame arrangement having a sunken seating portion therewithin. The frame arrangement is generally elongate and the suspension section is connected to one end of the frame and is adapted to in one position be upwardly angled to have a free end thereof, generally above and centered at the mid point of the elongate frame arrangement. The suspension section is movable to a storage position. A suitable suspension arrangement can be secured to the free end of the suspension section preferably at two points on the free end generally above the frame arrangement and to either side thereof. This seating unit is particularly advantageous when sized for use as an infant swing where the full advantages of collapsibility for storage or transport are utilized. In addition, the infant swing because of its unique design uses the suspension section for providing a canopy over an end portion of the elongate frame. A further advantage is that the sides of the swing seating unit are generally open thereby allowing more convenient placement or removal of an infant from the swing.

19 Claims, 6 Drawing Figures

FIG. 1.
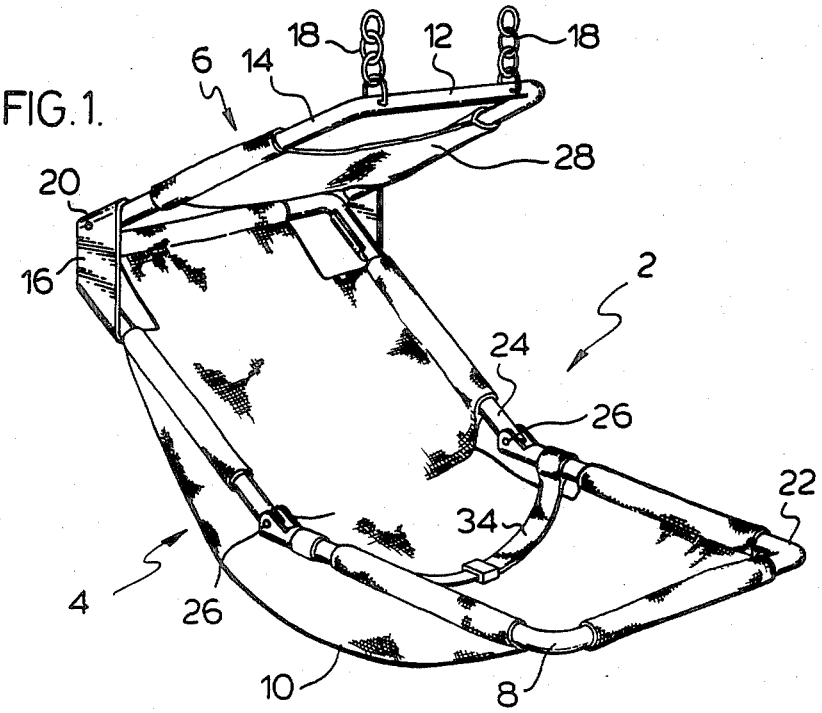
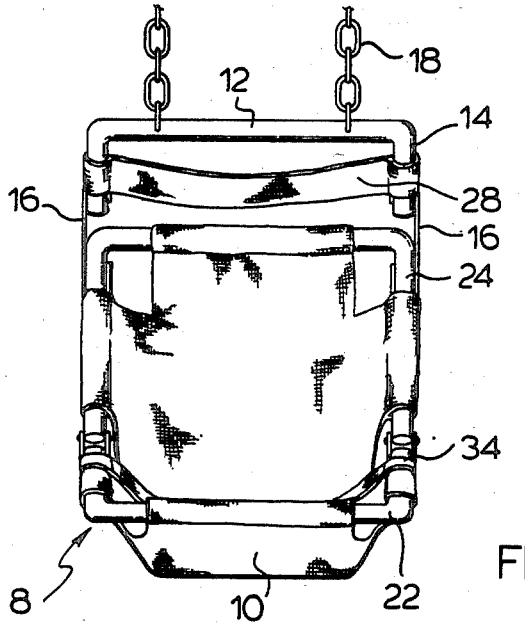
FIG. 2.

SWING SEATING UNIT

BACKGROUND OF THE INVENTION

The present invention relates to swings and particularly a collapsible seating unit for swings and/or an infant swing.

Many infant swings have been proposed such as those exemplified in U.S. Pat. No. Des. 230,921; U.S. Pat. No. Des. 248,518; U.S. Pat. Nos. 953,897; 1,463,499 as but some examples. Other infant care equipment includes the structure disclosed in U.S. Pat. No. 3,049,727 entitled Foldable Craddle and U.S. Pat. No. Des. 264,148 entitled Combined Swing for Infant and Removable Canopy Therefor.

Although these structures operate satisfactorily, they have some disadvantages with respect to the ease in which the infant may be placed in or removed from the swing and the complexity of the components contribute to a fairly expensive final product. In applicant's opinion, too much emphasis has been placed on optimum suspension of the various seating units, resulting in significant shortcoming in the ease of use of the equipment. There remains a need to provide a simple swing which can be produced economically and this swing need not be limited to the infant application.

SUMMARY OF THE INVENTION

According to the present invention, a seating unit for a swing comprises a seating section and a suspension section with the seating section including frame arrangement having a sunken seating portion therewithin. The frame arrangement is generally elongate and the suspension section is connected to one end of the frame arrangement. This suspension section is adapted to in one position be upwardly angled to have a free end thereof above, and generally centered at the mid point of the frame arrangement and movable to a storage position with the suspension section generally nested within or above the frame arrangement. Means for suspending the seating unit from the suspension section adjacent the free end thereof is provided. Two points of suspension are provided with each point being above the frame arrangement with the points located generally to opposite sides of the frame arrangement.

According to a preferred aspect of the invention, a collapsible infant swing is taught which has a seating unit having three aligned frame sections of similar widths with the sections including an end section, a middle section and suspension section. Means for securing the sections to allow movement to a storage position is provided, such that the end section and the suspension section generally stack above each other when placed in the storage position. The securing means allows movement of the various sections to a swing position with the middle and suspension sections forming an acute angle therebetween in the range of 45° to 75° and the end section is movable to a position generally in an end-to-end orientation with the middle section. Thus the sections can collectively define therebetween a large elongate frame about the length of the length of the middle and end sections, and the elongate frame includes a suspended seating portion of a foldable material secured to the frame.

BRIEF DESCRIPTION OF THE DRAWINGS

Preferred embodiments of the invention are shown in the drawings wherein;

FIG. 1 is a perspective view of the collapsible swing;

FIG. 2 is a front view of the collapsible swing;

DETAILED DESCRIPTION OF THE PREFERRED EMBODIMENTS

Figure 3:
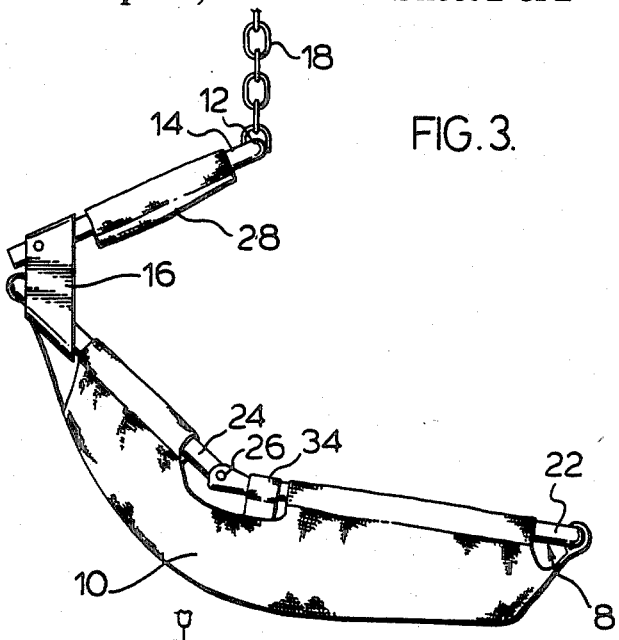
FIG. 3 is a side view of the collapsible swing.

The collapsible swing 2 has a seating unit generally shown as 4, which includes a suspension section generally shown as 6 secured to one end of the elongate metal tubing frame arrangement 8. Frame arrangement 8 supports the sunken seating portion 10, and the swing is designed either for an infant or an adult, and in the latter case requires stronger components. At the free end 12 of the suspension section 6, chains 18 are secured with one chain to either side of the frame arrangement 10 and in this case, the chains pass through holes in the free end 12. The frame 14 of the suspension section 6 is generally 'U' shaped, and open at the end of said elongate frame arrangement 8. Bracket members 16 are located on either side of the elongate frame 8 and are generally fixed to the elongate frame. The bracket members 16 also pivotally support the open end of the 'U' shaped frame 14 of the suspension section 6. The pivot of the frame 14 to the bracket 16 is generally shown as 20.

Figure 4:
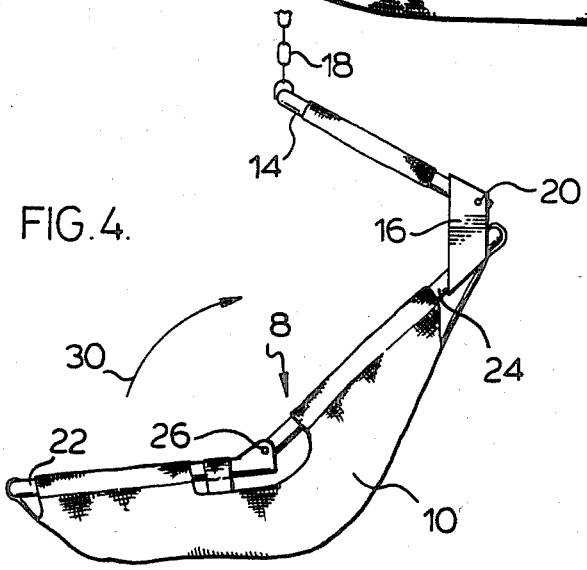
FIGS. 4, 5 and 6 are side views of the collapsible swing showing the various steps necessary to effect folding of the swing to the storage position.
Figure 5:
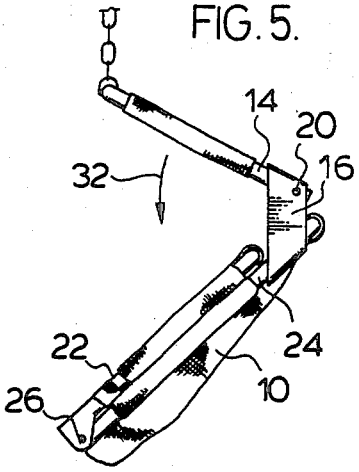
Figure 6:
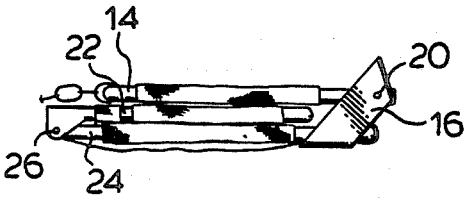

The suspension section 6 is pivotal about the pivot connection 20 to allow movement of the seating unit to a storage position by completing the operation as generally shown in FIGS. 4 through 6. The elongate frame arrangement 8 is preferrably divided by a pivot axis defined by pivots 26 which connect the middle frame 24 to the end frame 22. Thus each of the end frame and the middle frame are generally 'U' shaped and in the swing position are opposed to define the generally elongate frame. Each pivot 26 is such that a lock position is defined between the end frame and the middle frame, when positioned in the swing position and this lock is releasable such that the end frame is movable as indicated by arrow 30, to allow the end frame 22 to be generally parallel with and generally above the middle frame 24. Frame 14 of the suspension sections 6 may then be moved in the direction of arrow 32 such that it is generally parallel with and directly above the end frame 22 and the middle frame 24, as indicated in FIG. 6. You will note that brackets 16 space the suspension frame 14 from the middle frame 24, a certain distance sufficient to allow the end frame to be nested therebetween in the folded state.

The pivot connection 26 between the middle frame and the end frame may be adjustable, whereby the angle therebetween in the swing position can be varied. In certain cases, this may not be desired and if so, a fixed angle therebetween can be provided either by the pivot connection and/or the cooperation of the frames defining a fixed stop. As can be appreciated from the figures, an infant seated in the sunken seating portion will have most of his or her weight generally concentrated about the axis defined by the pivot connections 26. This would generally cause a particular orientation of the seating unit such that the free end 12 of the suspension section is generally above the pivot points. The center of gravity of the combined seating unit and infant, will cause a swinging of the seating unit about the free end 12 such that the free end is generally vertical aligned with the center of gravity. Any shift from this positioning will cause a non-equilibrium condition causing a slight rotation of the seating unit to achieve this orientation. Therefore, should the infant move, even if the swing was at equilibrium, the movement of the infant will cause a shift in the center of gravity resulting in a gentle rocking of the seating unit about the free end 12. As any parent will advise, this gentle rocking seems to comfort small infants. If the infant moves significantly within the seating unit, then some rocking about the pivot points of the chains 18 may result, thereby, providing a larger swing movement.

The middle frame 24 and the suspension frame 14 define an acute angle therebetween as determined by the cooperation of the frames and brackets 16 with the angle being in the range of 45° to 75° and preferably about 60°. When the seating unit is suspended, the middle frame is not horizontal but has an angle relative to the horizontal such that the suspension section 6 is generally directly above the middle frame 24, whereby the canopy 28 placed on the suspension frame 14 can provide shade for at least a portion of the middle frame if the sun is directly overhead. Therefore, in contrast to prior art structures, the suspension frame 14 in addition to providing a support arrangement for the seating unit, also serves to provide a structure suitable for suspension of the canopy material 28. This canopy 28 has been provided in a manner to leave the side areas between the suspension frame 14 and the middle frame 24 essentially clear of obstruction, thereby, allowing a parent to easily place an infant in the seating unit or remove an infant from the seating unit. In contrast, many prior art swings have a cluttered suspension arrangement which makes placement of the infant or removal of the infant from the swing difficult.

As shown in FIG. 3 the end frame, when the seating unit is suspended, is not precisely horizontal and there is a slight angulation to the sunken seating portion 10, whereby the infant has fairly good visibility while still being relatively secure in the sunken seating arrangement. Infants are often content merely to observe the activities around them and this orientation takes this fact into account. Preferably a safety strap 34 is provided generally adjacent the pivot points 26, whereby the infant may be restrained within the sunken seating portion 10.

The end frame 22 is not precisely aligned with the middle frame 24 and preferrably has an angled orientation as shown in FIG. 3. In the embodiment shown, the angle is about 135°. This angle can vary considerably and serves to reduce the tendency of an infant to slide in the seating portion.

The swing has been described and shown with pivot connections between the various frames which is the preferred structure. However, release of the suspension frame from the middle frame will accommodate a compressed storage state and the middle and end frame can be integral if the increased size of the storage state is acceptable. Therefore, collapsibility is preferrably provided by hinge-like connections, however, other arrangements are possible and fall within the scope of the present invention. To facilitate packaging and/or transport after sale, a knockdown frame structure is preferred.

Although various preferred embodiments of the present invention have been described herein in detail, it will be appreciated by those skilled in the art, that variations may be made thereto without departing from the spirit of the invention or the scope of the appended claims.

I claim:

1. A collapsible swing seating unit comprising a seating section and a suspension section, said seating section including a generally elongate frame arrangement having a sunken seating portion therewithin, said suspension section being connected to one end of said frame arrangement and being adapted to in one position be upwardly angled such that a free end thereof is above the mid point of the frame arrangement, said suspension section being movable relative to said frame arrangement to a collapsed storage position, and means for suspending said seating unit from said suspension section adjacent the free end thereof, said suspension section cooperating with said frame adjacent said one end to provide the sole structural connections therebetween, said structural connections being limited to said one end, leaving the remaining area intermediate said suspension section and said frame clear of obstruction.

2. A collapsible swing seating unit as claimed in claim 1, wherein said suspension section and said frame arrangement from an acute angle therebetween when said suspension section is in said one position, said acute angle being in the range of 45° to 75°.

3. A collapsible swing seating unit as claimed in claim 2, wherein said acute angle is about 60°.

4. A collapsible swing seating unit as claimed in claim 1, wherein said frame arrangement is foldable upon itself to define a hinge axis extending generally perpendicular to the elongate direction of said frame arrangement.

5. A collapsible swing seating unit as claimed in claim 4, wherein said suspension section is pivotally secured for pivotal movement between said one position and said storage position.

6. A collapsible swing seating unit as claimed in claim 1, wherein said suspension section carries a canopy for an end section of said frame arrangement.

7. A collapsible swing seating unit as claimed in claim 6, wherein said frame arrangement is made of metal tubing and said suspension section is of metal tubing, said frame arrangement and said suspension section being connected by brackets on either side of said frame arrangement, said brackets pivotally securing said suspension section and predetermining the one position thereof.

8. A collapsible swing seating unit as claimed in claim 7, wherein said seating section and said canopy are each made of a fabric material secured to the metal tubing of said frame arrangement and said suspension section respectively.

9. A collapsible infant's swing seating unit having three aligned frame sections of similar widths including an end section, a middle section and a suspension section, and means for securing said sections to allow movement to a storage position with said end and said suspension section generally stacked above and parallel with said middle section, said securing means allowing movement of said sections to a swing position with said middle and suspension sections forming an acute angle therebetween in the range of 45° to 75°, and said end section movable to a position to collectively define with said middle section a large elongate frame, said elongate frame including a suspended seating portion of a foldable material secured to said frame, and wherein said securing means includes limiting brackets intermediate said middle frame and said suspension frame and either side of said frame, said brackets predetermining the swing position of said frames.

10. A collapsible infant's swing seating unit as claimed in claim 9, wherein said suspension frame is of a length to be above the connection of said end frame and said middle frame when said seating unit is in the swing position and includes means for suspending said seating unit from said suspension frame adjacent the free end thereof.

11. A collapsible infant's swing seating unit as claimed in claim 9, wherein said swing between said suspension frame and said middle frame either side of said frames is clear of obstructions.

12. A collapsible infant's swing seating unit as claimed in claim 9, wherein said suspension frame supports a fabric therewithin which acts as a canopy for a portion of said suspended seating portion.

13. A collapsible infant's swing seating unit as claimed in claim 12, wherein said end frame and said middle frame are securable at different angle positions each defining a swing position.

14. An infant's swing seating unit as claimed in claim 13, wherein said frames are generally of equal width and generally of a rectilinear like shape.

15. An infant's swing seating unit as claimed in claim 13, wherein each frame is generally 'U' shaped in plan view, with said end frame and said middle frame joined at free ends to define a generally rectangular like closed support, and said suspension frame is pivotally secured at the free ends thereof to an end of said middle frame.

16. A swing seat unit comprising;

a seating section and a suspension section, said seating section including a sunken seating portion supported at various points about the exterior thereof by a frame, said suspension section being non-fixedly connected to one end of said frame to in one position cooperate with and provide the sole support for said frame when said seating unit is hung from a free end of said suspension section opposite said one end, said suspension section and said frame in said one position defining an acute angle therebetween with said free end generally centered above the mid point of said frame with respect to the length of said frame, said suspension being movable to a collapsed position relative to said frame suitable for storage.

17. A swing seat unit as claimed in claim 16, wherein said sunken seating portion includes an extension attached to said suspension section to thereby provide a canopy for said seating portion.

18. A swing seat unit as claimed in claim 16, wherein said suspension section and said frame are hingedly connected.

19. A swing seat unit as claimed in claim 16, wherein said suspension section is releasable from said frame to effect movement to a storage position.

* * * * *